US005428915A

United States Patent [19]

King

[11] Patent Number: 5,428,915

[45] Date of Patent: Jul. 4, 1995

[54] DETACHABLE SIGHT MOUNT WITH ELEVATION ADJUSTMENT

[76] Inventor: Kory A. King, 807 Twelfth St., Bellingham, Wash. 98227

[21] Appl. No.: 126,413

[22] Filed: Sep. 27, 1993

[51] Int. Cl.[6] ..... E41G 1/387

[52] U.S. Cl. ..... 42/101; 33/248

[58] Field of Search ..... 42/101; 33/245, 247, 33/248, 250

[56] References Cited

U.S. PATENT DOCUMENTS

| | | | |
|---|---|---|---|
| 2,237,395 | 4/1941 | Sweet | 42/101 |
| 2,350,169 | 5/1942 | Kesselring | 33/249 |
| 2,576,347 | 11/1951 | Jones | 42/101 |
| 2,583,260 | 1/1952 | Felix | 42/101 |
| 2,743,525 | 5/1956 | Leupold | 33/248 |
| 2,743,526 | 5/1956 | Ivy | 33/248 |
| 2,854,748 | 10/1958 | Williams | 42/101 |
| 2,857,675 | 10/1958 | Kesselring | 33/245 |
| 3,406,455 | 10/1968 | Akin | 33/245 |
| 3,414,221 | 12/1968 | Nelson | 42/101 |

FOREIGN PATENT DOCUMENTS

| | | | |
|---|---|---|---|
| 1289286 | 2/1962 | France | 42/101 |

*Primary Examiner*—David Brown
*Attorney, Agent, or Firm*—Olson & Olson

[57] ABSTRACT

A detachable mount for a rifle telescope sight includes front and rear clamp support bases configured for attachment to a rifle, the bases having in their lateral side walls a plurality of detents arranged to receive the rounded ends of mounting screws extending through laterally spaced legs on front and rear scope clamp members configured for mounting on a telescope sight. The plurality of detents on the front base are arranged on a common axis that extends parallel to the longitudinal axis of the rifle barrel, and the plurality of detents on the rear base are arranged on a common axis that extends obliquely with respect to the axis of the front base detents, whereby to enable adjustment of the longitudinal axis of the telescope sight vertically relative to the rifle barrel. The spacing between the detents on the front base is different from the spacing between the detents on the rear base, whereby to ensure that a removed telescope sight must be returned to the same detents from which it had been removed. In a second embodiment, the obliguely arranged detents are replaced with a single detent in each end of a cam shaft mounted rotatably on the rear base for movement of the detent vertically across the common axis of the detents on the first base. A set screw releasably secures the cam shaft in desired position of adjustment of the detents.

10 Claims, 3 Drawing Sheets

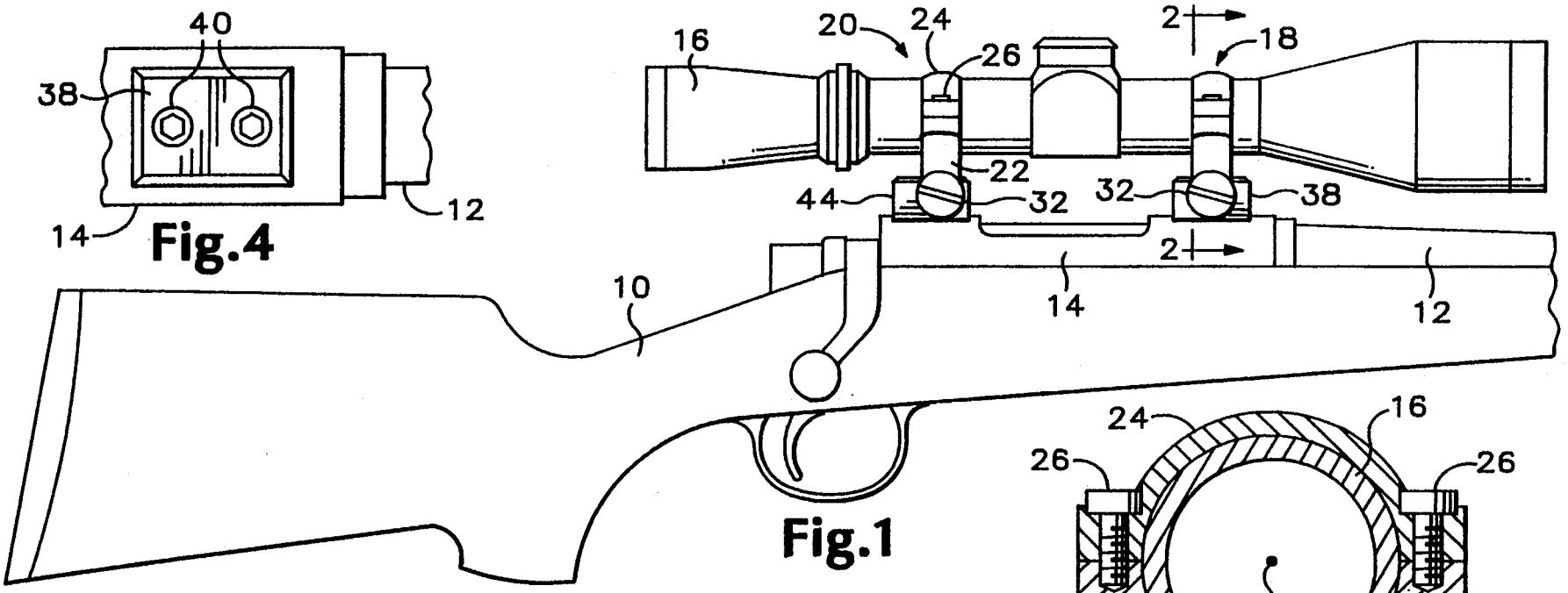
Fig.1
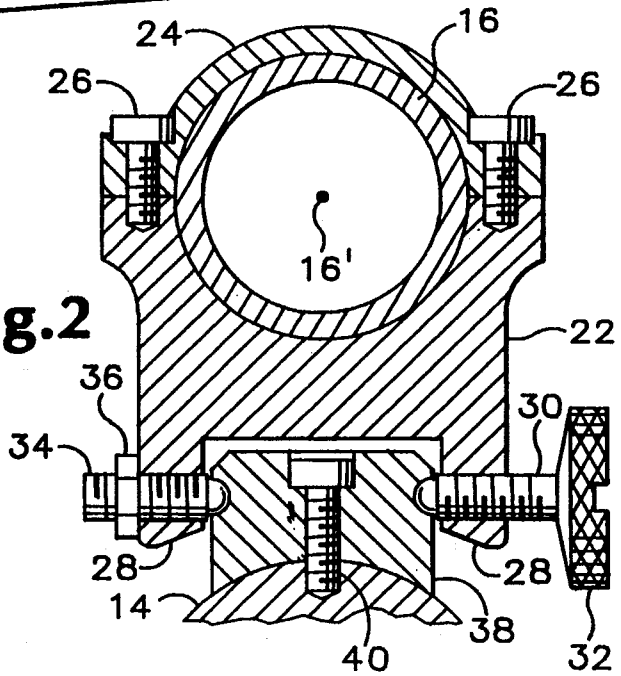
Fig.2
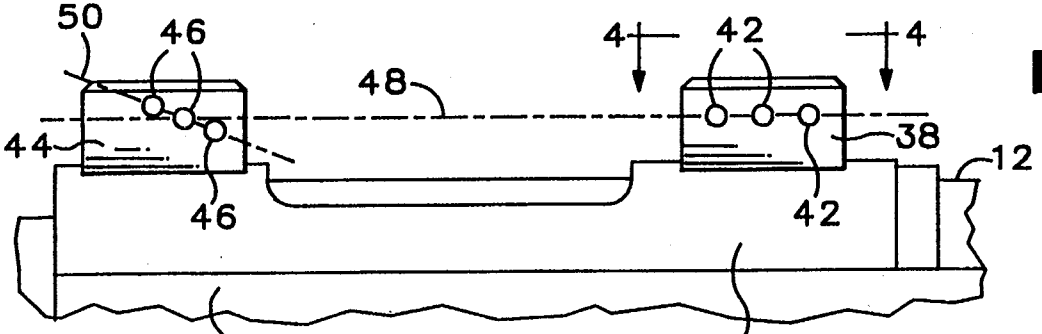
Fig.3
Fig.4

DETACHABLE SIGHT MOUNT WITH ELEVATION ADJUSTMENT

BACKGROUND OF THE INVENTION

This invention relates to telescope mounts for firearms, and more particular to a detachable telescope mount that is also adjustable for windage and elevation.

Detachable telescope mounts for rifles have been provided heretofore. Typical of these are the telescope mounts described in U.S. Pat. Nos. 2,350,169; 2,743,526; and 2,857,675. Although U.S. Pat. Nos. 2,743,526 and 2,857,675 disclose telescope mounts that accommodate lateral adjustment for windage compensation, none of the patents provides a telescope mount that affords vertical adjustment for variations in elevation. Telescope mounts that are adjustable for elevation heretofore have involved very complex and costly constructions. Exemplary of these is the telescope sight mount disclosed in U.S. Pat. No. 2,743,525.

SUMMARY OF THE INVENTION

The mount of this invention is intended to support a telescope sight or other target sighting device and includes front and rear clamp support base members configured for attachment to a firearm or other device which is capable of being aimed at a target. Corresponding front and rear clamp members are configured for attachment to an elongated target sighting device, and connector means on the base and clamp members are arranged to interconnect said clamp members and to enable adjusting the longitudinal axis of the target sighting device to various lateral positions and vertical angles relative to the line of sight to a target, to effect adjustment of windage and elevation.

It is the principal objective of this invention to provide a detachable telescope mount that is adjustable for elevation as well as for windage.

Another objective of this invention is the provision of a detachable telescope mount that is adjustable for windage and elevation and includes means that insures re-attaching the mount in the same point of impact adjustment as previously established.

A further objective of this invention is to provide a detachable telescope mount of the class described that is of simplified construction for economical manufacture.

The foregoing and other objects and advantages of this invention will appear from the following detailed description, taken in connection with the accompanying drawings of a preferred embodiment.

BRIEF DESCRIPTION OF THE DRAWINGS

FIG. 1 is a fragmentary side elevation of a rifle having mounted thereon a detachable telescope mount embodying the features of this invention.

FIG. 2 is a fragmentary transverse sectional view, on an enlarged scale, taken on the line 2—2 in FIG. 1.

FIG. 3 is a fragmentary side elevation of the receiver portion of the rifle of FIG. 1, showing the telescope clamp mounting bases.

FIG. 4 is a fragmentary plan view of one of the mounting bases as viewed in the direction of the arrows 4—4 in FIG. 3.

DESCRIPTION OF THE PREFERRED EMBODIMENT

Figure 5:
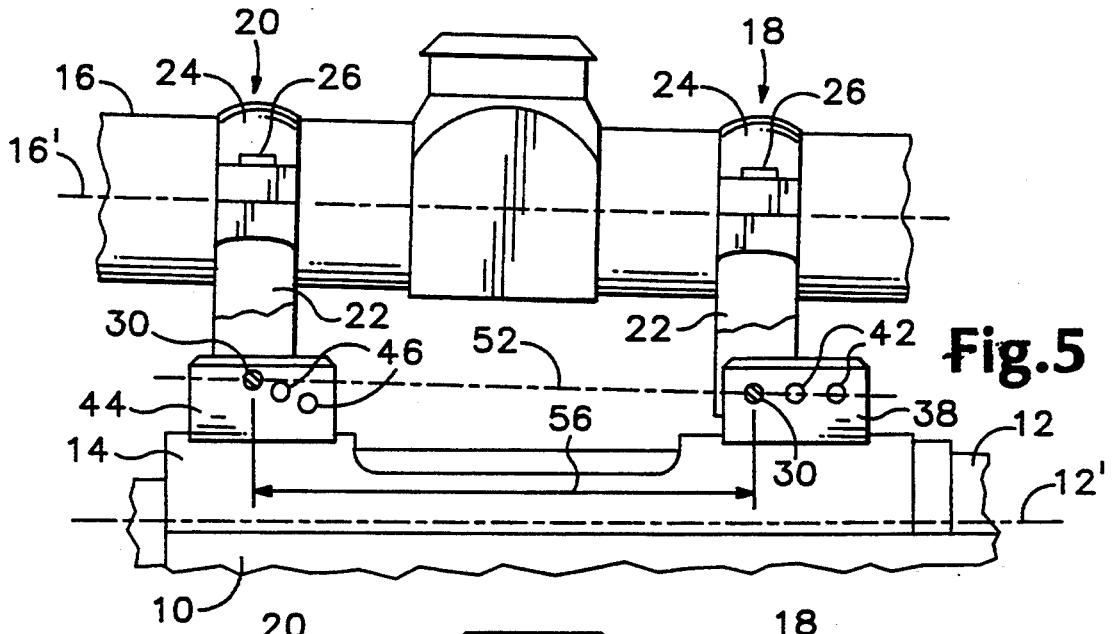
FIGS. 5, 6 and 7 are fragmentary side elevations, similar to FIG. 1, showing the mounting of a telescope in various positions of elevation adjustment.

Referring first to FIG. 1 of the drawings, there is illustrated a typical form of rifle which includes a stock 10 and an elongated barrel 12 extending from a receiver 14. An elongated telescopic gunsight 16 is shown mounted on the rifle by means of front and rear clamp members 18 and 20, respectively. The front and rear clamp members are of identical construction and, as shown in FIG. 2, each includes a clamp body 22 and cap 24 secured together detachably by means of screws 26. The body and cap are provided with confronting semicircular surfaces corresponding to the diameter of the telescopic sight, for clamping the latter between them.

The clamp body 22 is provided with a pair of laterally spaced, downwardly extending legs 28 provided with threaded bores having a common transverse axis. One of the threaded bores receives a threaded screw 30 provided with an enlarged knurled head 32 for convenient hand manipulation. The other threaded bore receives a threaded screw 34 provided on its outer end with a screwdriver slot or Allen wrench socket, to facilitate rotation. A lock nut 36 on the screw 34 serves to secure the latter in adjusted position.

Associated with the front clamp member 18 is a mounting base 38 configured for attachment to the rifle receiver 14 by means of screws 40. The lateral vertical walls of the mounting base 38 are provided with a plurality of detents 42 configured to releasably receive the inner, rounded ends of the screws 30 and 34. Similarly, the rear telescope sight clamp member 20 is associated with a rear clamp mounting base 44 secured to the rifle receiver, as by similar screws 40. The lateral vertical walls of the rear mounting base 44 are provided with a plurality of detents 46 also configured to releasably receive the inner ends of the screws 30 and 34.

Referring primarily to FIG. 3 of the drawings, it is to be noted that the front detents 42 are spaced apart longitudinally on the common axis 48 which extends parallel to the longitudinal axis 12' of the rifle barrel 12 and hence parallel to the line of sight to a target at which the rifle is to be aimed. The rear detents 46 are shown to be spaced apart longitudinally and disposed on a common axis 50 that extends obliquely with respect to the axis 48. The center detent 46 is disposed on the common axis 48, while at least one additional detent 46 is disposed above said common axis and at least one additional detent 46 is disposed below said common axis 48.

It is to be understood that the rear detents 46 need not be disposed on a common axis such as the axis 50 illustrated. Rather, it is necessary only that at least one detent be located above and one below the center detent positioned on the common axis 48.

Figure 6:
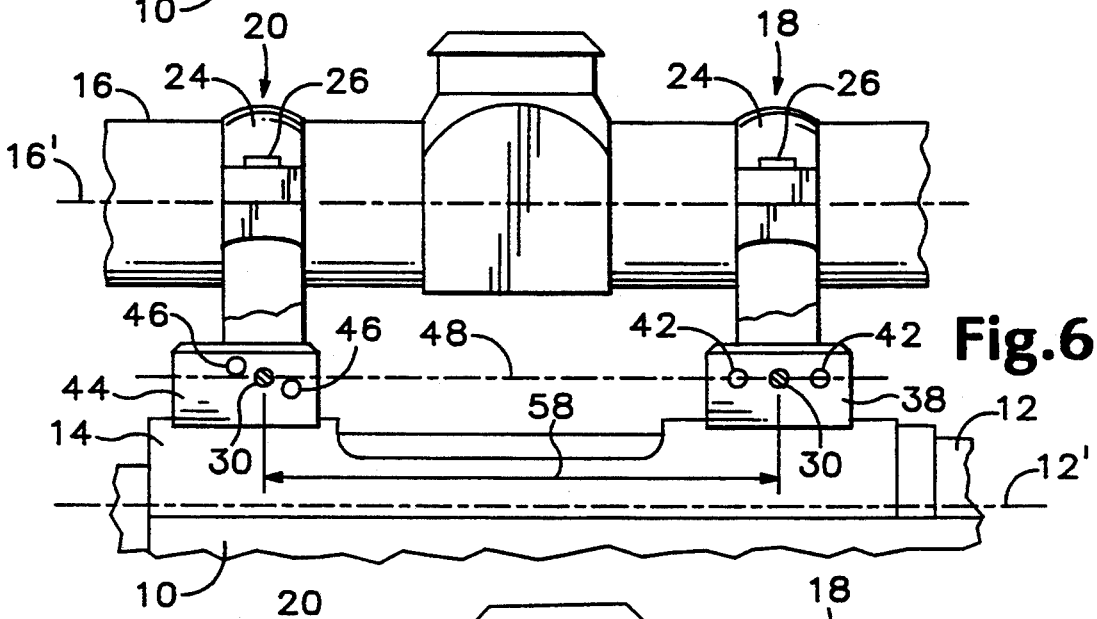
Figure 7:
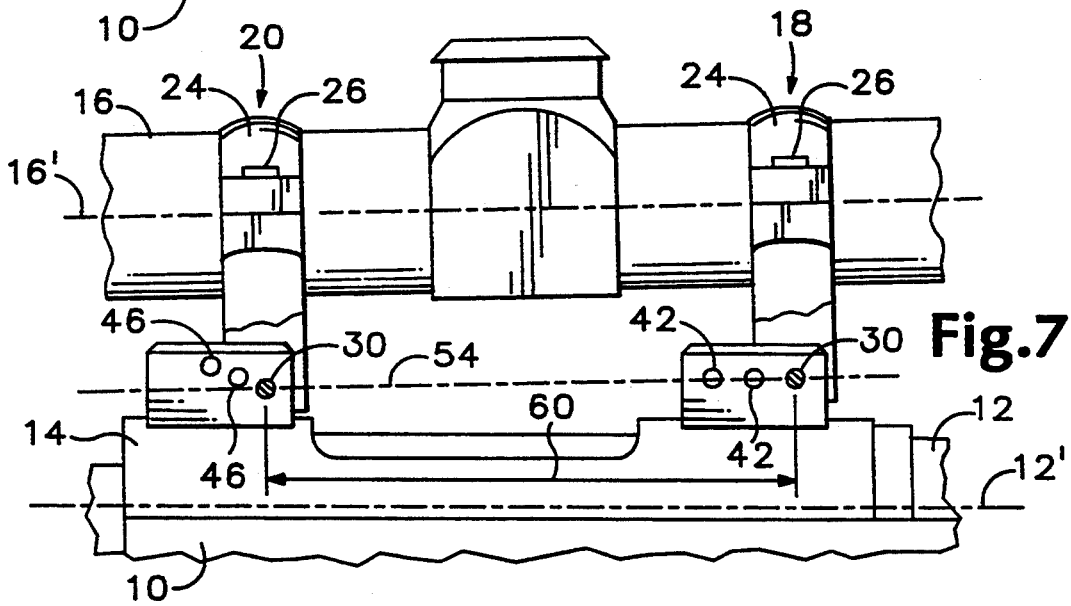
Figure 8:
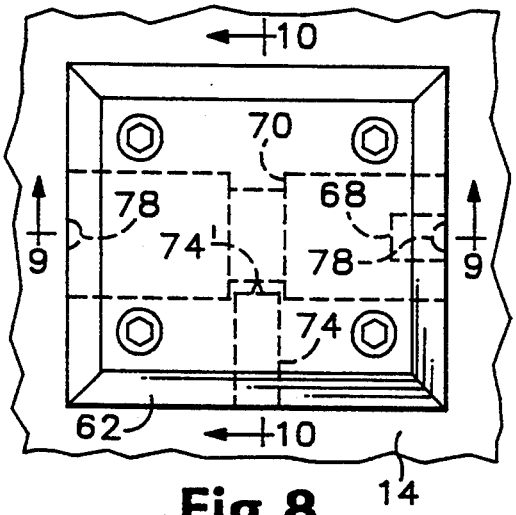
FIG. 8 is a fragmentary plan view of a second embodiment of elevation adjustment mechanism embodying the features of this invention.
Figure 9:
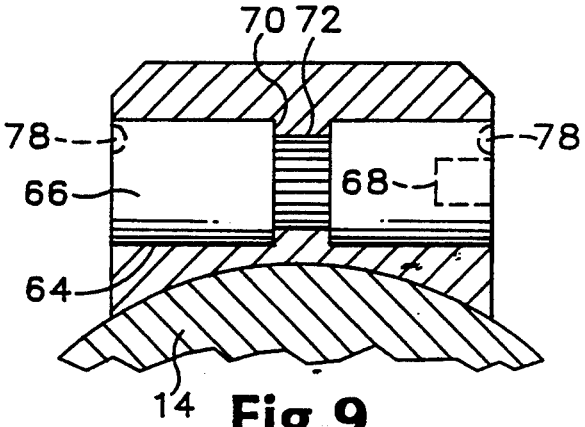
FIG. 9 is a fragmentary sectional view taken on the line 9—9 in FIG. 8.
Figure 10:
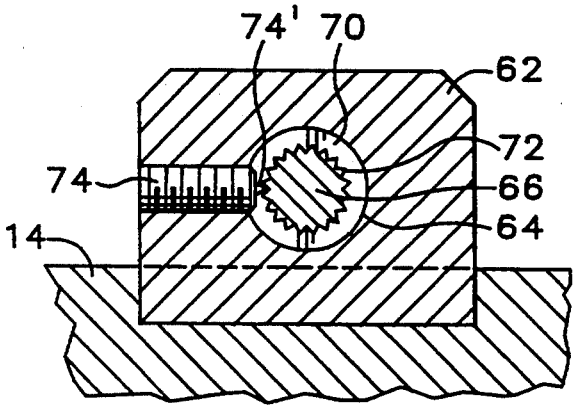
FIG. 10 is a fragmentary sectional view taken on the line 10—10 in FIG. 8.
Figure 11:
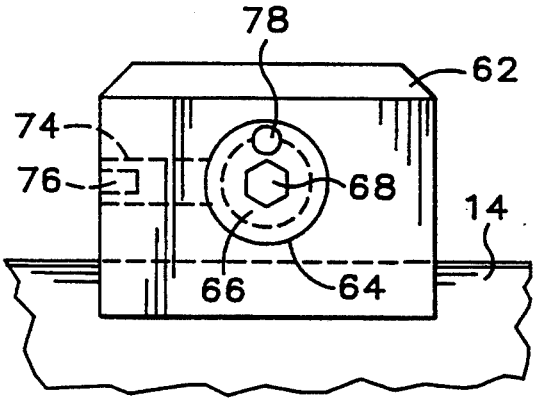
FIG. 11 is a fragmentary side elevation as viewed from the right in FIG. 8.

Referring now to FIGS. 5, 6 and 7 of the drawings, FIG. 6 illustrates the mounting of the telescope sight 16 with its longitudinal axis 16' disposed parallel to the common axis 48 and hence parallel to the longitudinal axis 12' of the rifle barrel 12. This is achieved by positioning the front and rear clamp members 18 and 20, respectively, on the telescopic sight so that the leg screws 30 and 34 on the rear clamp 20 engage the central one of the detents 46 on the rear base 44 and the leg screws 30 and 34 on the front clamp 18 engage any one of the detents 42 on the front base 38.

Let it be assumed that it is now desired to extend the range from the setting provided by the arrangement shown in FIG. 6. For this purpose the screws 30 and 34 are withdrawn from the detents 42 and 46 illustrated in FIG. 6 and the leg screws 30 and 34 of the rear clamp member 20 are tightened into the detents 46 on base 44 that are positioned above the central detent, as shown in FIG. 5. The front clamp member 18 is loosened slightly to allow movement relative to the telescope sight so that the leg screws 30 and 34 will align with one pair of detents 42 on base 38, after which the front clamp member is secured to the telescope sight by tightening the screws 26. The leg screws 30 and 34 on the front clamp member then are tightened into the selected pair of detents 42.

The longitudinal axis 16' of the telescope sight 16 and the parallel axes 52 through the detents 30 in bases 38 and 44 occupied by the leg screws 30 and 34, thus both converge forwardly toward the common axis 48 and hence the longitudinal axis 12' of the rifle barrel. This effectively increases the range and correspondingly the elevation to which the rifle is adjusted.

Let it now be assumed that it is desired to reduce the range, and hence the elevation, from that established by the parallel arrangement of FIG. 6. Referring to FIG. 7 of the drawings, the leg screws 30 and 34 are loosened for removal from the position illustrated in FIG. 5. The rear clamp leg screws 30 and 34 then are positioned for engagement in the detents 46 of the rear base 44 that are located below the central detent, and then tightened into the lower detents. The front clamp member 18 once again is loosened from the telescope sight 16 for movement to align the front leg screws 30 and 34 with a selected pair of the front base detents 42. The front clamp member is tightened about the telescope sight and the front clamp leg screws 30 and 34 are tightened into the selected detents. The longitudinal axis 16' of the telescope sight and the parallel axes 54 of the detents occupied leg screws 30 and 34 thus diverge forwardly from the common axis 48 and hence the longitudinal axis 12' of the rifle barrel to effectively decrease the range and elevation setting.

It is to be noted in FIGS. 5, 6 and 7 that the longitudinal spacing between detents 42 is different from the longitudinal spacing between adjacent detents 46. This arrangement insures that when the telescope sight is removed from the rifle and then replaced upon the rifle, it can only be replaced into the same detent arrangement to which it had been adjusted prior to its removal. Thus, the distance 56 between the rearwardmost detents 46 on the rear base 44 and the rearwardmost detents 42 on the front base 38 in FIG. 5 is different from distance 58 between the center detents in FIG. 6 which, in turn, is different from the distance 60 between the forwardmost detents in FIG. 7. Accordingly, in reinstalling the telescope sight on the rifle, it is not possible to change the range setting since the leg screws 30 and 34 on both front and rear clamp members will match only the detents to which they had been previously adjusted.

It is also to be noted from FIGS. 5, 6 and 7 that the magnitude of elevation adjustment may be varied by varying the distance between the front and rear leg screws. For example, by moving the front clamp member 18 in FIG. 7 to align the leg screws 30 and 34 with the detents 42 at the far left, rather than at the far right as illustrated, the axis 54, and hence the axis 16' of the telescope sight, will diverge forwardly at a greater angle from the axis 12' of the rifle barrel than as shown.

The embodiment illustrated in FIGS. 8–11 affords incremental adjustment of elevation within a defined range. To this end, the rear clamp mounting base 62 is provided with a transverse bore 64 which receives a cylindrical cam shaft 66 for axial rotation therein. An Allen wrench socket 68, or screwdriver slot, in one end of the cam shaft facilitates rotation of the shaft.

An annular groove 70 intermediate the opposite ends of the cam shaft forms a cylindrical locking member of reduced diameter provided with serrations 72 closely spaced about the circumference. A set screw 74 in a threaded bore in the base 62 has an inner pointed end 74' arranged to releasably engage the serrations to secure the cam shaft in any desired position of rotation.

The inner end of the set screw 74 also projects into the annular groove 70 to secure the shaft against axial displacement in the bore 64. An Allen wrench socket 76, or screwdriver slot, in the outer end of the set screw facilitates its rotation.

The opposite outer ends of the cam shaft 66 are provided with axially aligned detents 78 disposed off-center with respect to the rotational axis of the shaft. The detents are configured, like detents 46, to releasably receive the inner ends of leg screws 30 and 34 to secure the rear clamp member 20 thereto.

Adjustment of elevation of the telescope sight 16 is achieved by loosening the front clamp member 18 on the telescope sight 16, and also loosening the set screw 74 from engagement with the serrations 72 in the base of the groove 70. The cam shaft 66 then is rotated, by use of an Allen wrench engaged in socket 68, to rotate the detents 78 about the rotational axis of the shaft, in cam-like manner, to a position which adjusts the telescope sight to the desired elevation. The set screw 74 is tightened against the serrations 72 to secure the cam shaft 66 against rotation, and the front clamp member 18 is tightened about the telescope sight.

As in the previous embodiment, the telescope sight may be removed from the rifle with the assurance that its subsequent re-installation on the rifle will be at the same position of elevation it occupied before removal.

It will be appreciated that the embodiment of FIGS. 8–11 provides a multiplicity of incremental adjustments of elevation, as compared with the three positions of adjustment afforded by the three detents 46.

From the foregoing, it will be apparent that this invention provides a telescope sight mount of simplified construction for economical manufacture, which is readily detachable from and attachable to a rifle with speed and facility and which assures the re-mounting of the telescope sight at the same elevation setting as was established prior to detaching it from the rifle.

It is to be noted that the clamp leg screws 30 and 34 may also be manipulated to shift the longitudinal axis 16' of the telescope sight laterally for windage compensation, as in the manner of the prior U.S. Pat. No. 2,857,675 identified hereinbefore.

It will be apparent to those skilled in the art that various changes may be made in the size, shape, type, number, and arrangement of parts described hereinbefore. For example, the separate front and rear bases 38 and 44 may be provided as a single elongated piece with the detents 42 and 46 or 78' located adjacent the opposite ends thereof. The number of detents 46 located to opposite sides of the central detent may be varied, as desired. So, also, may the number of detents 42 be varied from a minimum of one to more than the three illustrated.

Clamp members 18 and 20 may take diverse forms, it being required only that they cooperate with a selected form of mounting base. The front and rear clamp support base members 38 and 44 may be interchanged, i.e. the detents 42 may be positioned to the rear of detents 46 or 78. The mount may be utilized to mount a telescope sight, or laser sight, or any other form of target-sighting device, on any type of firearm, archery bow, or other device which is capable of being aimed at a target. The foregoing and other changes and modifications may be made, as desired, without departing from the spirit of this invention and the scope of the appended claims.

I claim:

1. A detachable mount for a target sighting device, comprising:

a) front and rear clamp members configured for attachment to a target sighting device at longitudinally spaced positions, b) front and rear clamp support base members configured for attachment to a device to be aimed at a target, and c) connector means on the base and clamp members for interconnecting said members for adjusting the longitudinal axis of a target sighting device to various vertical angles relative to the line of sight to a target, to effect adjustment of elevation, the connector means comprising:

1. first detent means on one of the front and rear base members disposed on an axis extending parallel to the line of sight to a target,
2. second detent means on the other of said front and rear base members configured to be disposed selectively on the axis of said first detent means and on opposite sides of said axis, and
3. a pair of laterally spaced legs on each of the front and rear clamp members mounting adjustable leg screws configured for reception in said first second detent means.

2. A detachable mount for a target sighting device, comprising:

a) front and rear clamp members configured for attachment to a target sighting device at longitudinally spaced positions, b) front and rear clamp support base members configured for attachment to a device to be aimed at a target, and c) connector means on the base and clamp members for interconnecting said members for adjusting the longitudinal axis of a target sighting device to various vertical angles relative to the line of sight to a target, to effect adjustment of elevation, the connector means comprising:

1. a first detent on one of the front and rear base members, said first detent being disposed on an axis extending parallel to the line of sight to a target,
2. a plurality of longitudinally spaced second detents on the other of said front and rear base members, one of said second detents being disposed on said axis of said first detent and others of said second detents being disposed on opposite sides of said axis of said first detent, and
3. a pair of laterally spaced legs on each of the front and rear clamp members mounting adjustable leg screws configured for reception in said first and second detents.

3. The detachable mount of claim 2 including a plurality of said first detents spaced apart longitudinally on said axis, the spacing between the first detents being different from the spacing between the second detents, whereby to insure replacing a previously adjusted telescope sight to the same elevation setting subsequent to its removal from the device to be aimed at a target.

4. The detachable mount of claim 2 wherein the detents are located on the opposite lateral vertical walls of the base members.

5. A detachable mount for a target sight device, comprising:

a) front and rear clamp members configured for attachment to a target sighting device at longitudinally spaced positions, b) front and rear clamp support base members configured for attachment to a device to be aimed at a target, and c) connector means on the base and clamp members for interconnecting said members for adjusting the longitudinal axis of a target sighting device to various vertical angles relative to the line of sight to a target, to effect adjustment of elevation, the connector means comprising:

1. first detent means on one of the front and rear base members, disposed on an axis extending parallel to the line of sight to a target,
2. cam means,
3. second detent means on the cam means,
4. means mounting the cam means on the other of said first and second base members for movement relative to said second base member for moving said second detent means vertically across said axis, and
5. a pair of laterally spaced legs on each of the front and rear clamp members mounting adjustable leg screws configured for reception in said first and second detents.

6. The detachable mount of claim 5 wherein the cam means comprises a shaft mounted on the base member for rotation about its longitudinal axis, the second detent means are axially aligned detents on the opposite ends of the shaft disposed off-center with respect to the rotational axis of the shaft, and lock means on the base member releasably engages the shaft for securing said shaft against rotation.

7. A detachable mount for a target sighting device, comprising:

a) front and rear clamp members configured for attachment to a target sighting device at longitudinally spaced positions and each having a pair of laterally spaced legs configured for mounting adjustable leg screws, b) front and rear clamp support base members configured for attachment to a device to be aimed at a target and each having laterally spaced side walls dimensioned for reception between the pair of laterally spaced legs of the associated clamp member, c) a plurality of longitudinally spaced first detents on the opposite lateral side walls of one of the front and rear base members, said first detents being disposed on a common axis and said base member being configured for attachment to a device to be aimed at a target with said common axis disposed parallel to the line of sight to a target, d) a plurality of longitudinally spaced second detents on the opposite lateral side walls of the other of said front and rear base members, one of said second detents being disposed on the common axis of said first detents and others of said second detents being disposed on opposite sides of the common axis of said first detents, and e) connector screws on the laterally spaced legs of the clamp members releasably engageable with the detents for detachably securing the clamp members and attached target sighting device to the base members in a selected position of elevation adjustment.

8. The detachable mount of claim 7 wherein the spacing between the first detents is different from the spacing between the second detents, whereby to insure replacing a previously adjusted target sighting device to the same elevation setting subsequent to its removal from the device to be aimed at a target.

9. The detachable mount of claim 7 wherein the second detents are disposed on a common axis extending obliquely with respect to the common axis of the first detents.

10. The detachable mount of claim 7 for mounting a telescope sight on a firearm, wherein the clamp members are configured for attachment to a telescope sight and the clamp support base members are configured for attachment to a firearm.

* * * * *